US005263591A

United States Patent [19]

Taormina et al.

[11] Patent Number: 5,263,591

[45] Date of Patent: Nov. 23, 1993

[54] REFUSE RECYCLING SYSTEM

[75] Inventors: William C. Taormina; Vincent C. Taormina, both of Anaheim, Calif.

[73] Assignee: Taormina Industries, Inc., Anaheim, Calif.

[21] Appl. No.: 806,111

[22] Filed: Dec. 12, 1991

[51] Int. Cl.[5] ..... B07C 7/04

[52] U.S. Cl. ..... 209/630; 209/703; 209/705; 209/930; 209/942; 198/609; 198/560; 198/346

[58] Field of Search ..... 209/702, 703, 705, 706, 209/930, 630, 937, 942; 198/609, 758, 560, 346

[56] References Cited

U.S. PATENT DOCUMENTS

| | | | |
|---|---|---|---|
| 1,089,034 | 3/1914 | Baker | 209/703 X |
| 1,381,204 | 6/1921 | Lawry | 209/630 X |
| 1,382,856 | 6/1921 | Rigney | 209/630 |
| 1,431,667 | 10/1922 | Johnson | 209/630 X |
| 1,492,927 | 5/1924 | Krehbiel | 209/703 X |
| 1,783,700 | 12/1930 | Byington | 209/703 X |
| 1,906,331 | 5/1933 | Phelps . | |
| 2,200,677 | 5/1940 | Petersen . | |
| 2,257,567 | 9/1941 | Matanovich-Manov . | |
| 2,328,299 | 8/1943 | Schwab . | |
| 2,377,619 | 6/1945 | Ernst | 209/630 |
| 2,793,747 | 5/1957 | Pridy | 209/705 X |
| 2,928,518 | 3/1960 | Clancy . | |
| 3,595,389 | 7/1971 | Morgan et al. . | |
| 3,804,248 | 4/1974 | Talamantz . | |
| 4,187,775 | 2/1980 | Flender . | |
| 4,254,878 | 3/1981 | Marsh . | |
| 4,375,855 | 3/1983 | Floyd | 209/705 |
| 4,387,019 | 6/1983 | Dale et al. . | |
| 4,553,977 | 11/1985 | Fry . | |
| 4,635,860 | 1/1987 | Kruyer . | |
| 4,760,925 | 8/1988 | Stehle et al. . | |
| 4,929,342 | 5/1990 | Johnston . | |
| 4,949,528 | 8/1990 | Palik . | |
| 5,009,370 | 4/1991 | Mackenzie . | |
| 5,116,486 | 5/1992 | Pederson | 209/702 X |

FOREIGN PATENT DOCUMENTS 248543 6/1912 Fed. Rep. of Germany .

*Primary Examiner*—D. Glenn Dayoan

*Attorney, Agent, or Firm*—Knobbe, Martens, Olson & Bear

[57] ABSTRACT

A controllable refuse recycling system includes a conveyor for conveying refuse. The refuse is carried past a plurality of operating personnel who extract recyclable materials from the refuse, and deposit the extracted materials into separate deposit chutes. At least one deposit chute is situated directly in front of each operator so that the deposit chute is located on the conveyor itself, or on the other side of the conveyor from the operator. The system is also controllable, and includes a control deck for monitoring and controlling the operation of the system. In one embodiment, the operation of the refuse recycling system is modified depending upon the species of refuse which is introduced into the system, so that the system operates in a first mode when commercial refuse is received, and in a second mode when residential refuse is received.

6 Claims, 5 Drawing Sheets

REFUSE RECYCLING SYSTEM

BACKGROUND OF THE INVENTION

1. Field of the Invention

The present invention relates to waste management systems which process recyclable materials.

2. Description of the Related Art

In recent years, high priority has been given to the task of conserving natural resources while at the same time reducing the amount of waste which is transferred to landfills and other dump sites. In fact, the reduction of waste has become such a high priority that, in some states, legislation has been passed which mandates the reduction of waste that is transferred to landfills by as much as 50%. One way of accomplishing this goal is to increase the percentage of goods which are recycled in proportion to the total volume of refuse.

In previous refuse recycling systems, a flow of refuse is usually transported by a conveyor or similar means past a number of operators who manually extract recyclable materials from the flow of refuse. Each operator is assigned a particular kind of recyclable material (e.g., newspapers, plastics, glass, etc.) which that operator extracts from the refuse flow. The operators are positioned proximate to one or two chutes which lead to separate deposit banks, so that the operators are able to deposit the extracted recyclable materials into the chutes proximate to their position. Each chute is generally designated to receive only one kind of recyclable material so that each deposit bank accumulates only one type of material. The materials in each deposit bank are then packaged and transported to the appropriate recycling facilities. The materials which are not recovered from the refuse flow are typically transferred to a landfill or other waste disposal site.

The physical layout of such systems usually includes a conveyor belt which runs directly in front of the operator so that it is easy for the operator to identify and extract the appropriate materials. The chute or chutes are then typically positioned to the immediate right and/or left of the operator, and are generally made to have a relatively large receiving orifice, so that the operator can quickly deposit the extracted materials without having to turn and see where the extracted material is to be placed. This is important since, in the time it takes for an operator to turn and locate a chute, it is possible that a quantity of recyclable material which that operator might otherwise have extracted could pass out of reach of the operator, thereby decreasing the efficiency of the system. In addition, the necessity of turning back and forth between the conveyor and the deposit chute could contribute to operator fatigue.

Since it is important that the chutes be relatively large, and located proximate to the operator, additional chutes would have to be positioned somewhat behind the operator in conventional systems. This is disadvantageous because the operator would be required to turn around while depositing goods into those chutes. Thus, in order to preserve efficiency in such a system, each operator is effectively limited to two chutes.

Because each operator is effectively limited to two chutes, and each chute typically receives only one type of recyclable material, the number of types of recyclable materials recovered in such systems is usually limited. This is because it is often costly to employ additional operators and to construct additional recovery stations. Thus, waste management facilities are often reluctant to increase their operating costs in order to recover additional kinds of recyclable materials. As a result, certain kinds of recyclable materials are not recovered by facilities which use the previous systems described above. This, in turn, results in an increase in the amount of material which is transferred to landfills. In addition, this results in a greater consumption of natural resources because goods which could otherwise have been recycled are instead wasted.

Thus, a need exists for a refuse recycling system which provides for increased recovery of recyclable materials without compromising operator efficiency and without increasing operating costs.

In addition to the aforementioned shortcomings of previous waste management systems, certain other limitations exist with conventional refuse recycling systems. These further limitations are due, in part, to the inability of these systems to effectively distinguish between certain species of refuse. Refuse which is delivered to recycling facilities typically comes from two major sources: commercial and residential. It has been found that the proportions between the types of recyclable materials in commercial refuse is generally different from the proportions between the types of recyclable materials in residential refuse. Thus, to optimize the efficiency of a recycling system, it may be advantageous to alter the operation of the recycling system in accordance with the species of refuse (e.g., commercial or residential) which are delivered to the system. Most systems, however, do not alter their operation in accordance with the species of refuse which are delivered to them. This may oftentimes lead to processing inefficiencies and an increase in the amount of waste produced by such systems.

Thus, a further need exists for a refuse recycling system which may be controlled to increase processing efficiency in response to the introduction of different species of refuse.

SUMMARY OF THE INVENTION

The subject invention provides for a significant reduction of waste by increasing the volume of recyclable goods which are recovered from the refuse flow. This increase in the volume of recovered recyclable goods is attributable to an increase in the number of kinds of recyclable goods which each operator is able to recover. That is, rather than limiting each operator to one or two deposit chutes, the present invention allows an operator to function efficiently while using three or more deposit chutes.

The present invention comprises a semi-automated system for discriminating between and recovering multiple types of recyclable refuse. By increasing the number of recyclable materials which may be extracted from the flow of refuse, the overall volume of materials recovered is increased in proportion to the volume of refuse flow. In accordance with the invention, one or more deposit chutes are located in the middle of the conveyor belt so that they are situated directly in front of the operator. Therefore, the operator is able to quickly deposit materials into the deposit chutes without wasting significant time or effort. It has been found that the present invention allows an operator to function efficiently while employing five or more deposit chutes. This is because the deposit chutes which are located in the middle of the conveyor and in front of the operator are always within view and are readily accessible.

In accordance with a further aspect of the invention, there is provided a means for controlling the operation of a refuse recycling system so as to increase system efficiency in response to the introduction of different species of refuse. The refuse recycling system of the present invention includes a control deck which may be used to alter the operation of the system depending upon the kinds of material which are present within the refuse flow. The control deck is capable of altering such characteristics as the speed and direction of selected conveyors, in accordance with the species of refuse which is received (i.e., residential or commercial), so as to optimize the percentage of recyclable goods which are recovered. Thus, the efficiency of a refuse recycling system constructed in accordance with the present invention is further increased.

DETAILED DESCRIPTION OF THE INVENTION

Figure 1:
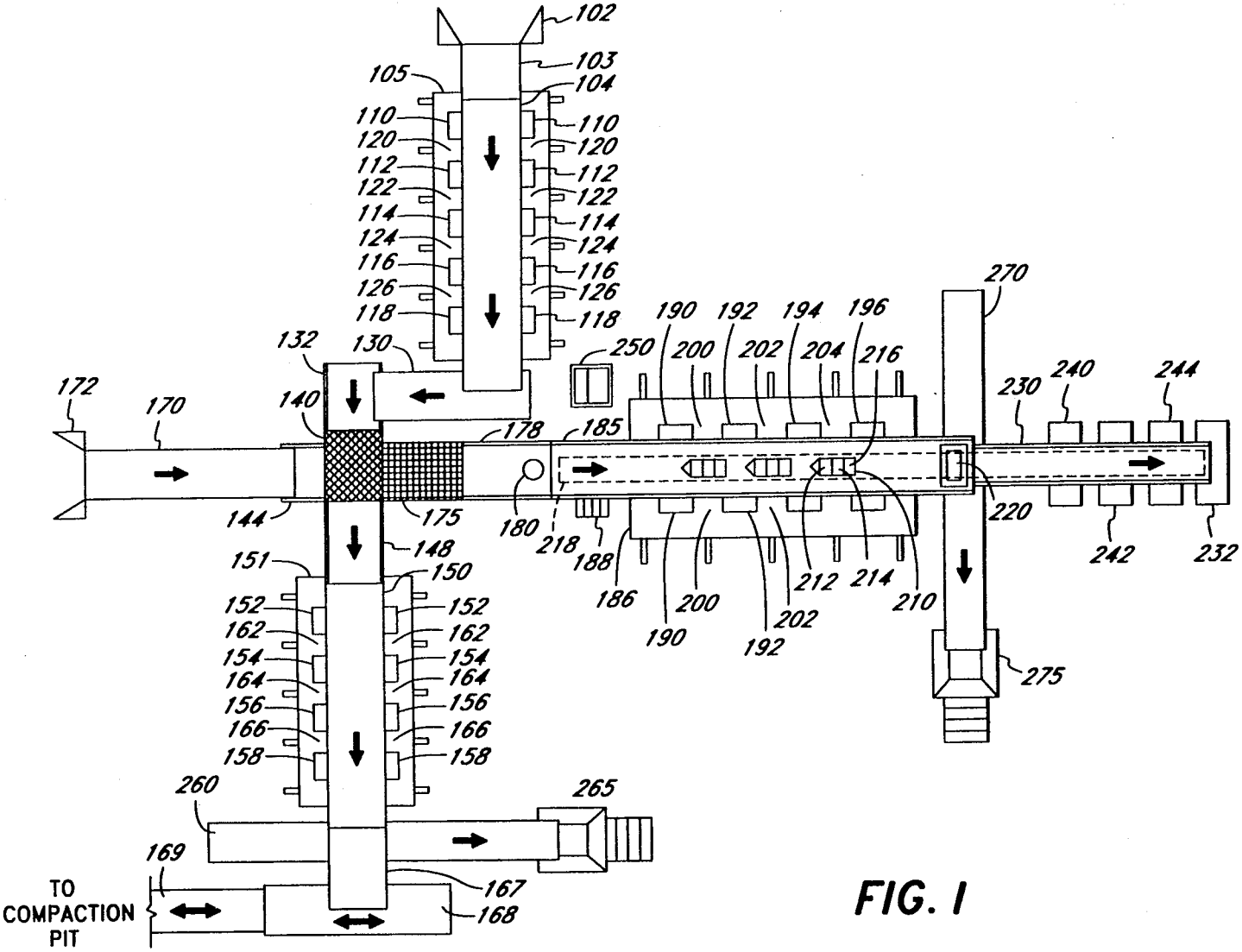
FIG. 1 is a plan schematic view showing the major structural elements of the refuse recycling system.

As shown in FIG. 1, the refuse recycling system 100 comprises two branches which are situated substantially perpendicular to one another, with refuse being conveyed in directions generally designated by arrows. The first branch begins at a main refuse inlet port 102 which is constructed to receive refuse of several kinds including paper, plastics, ferrous materials, glass, and other recyclable and nonrecyclable products. In one embodiment, the main inlet port 102 is approximately 6–8 feet wide at the mouth, and feeds into an infeed belt conveyor 103. The infeed conveyor 103 is situated between the inlet port 102 and a main belt conveyor 104 and is angled upward so that the refuse 300 is able to be carried to the main belt conveyor 104 at an elevated level on a platform 105. The main conveyor 104 is constructed of durable materials capable of moving large volumes of refuse past a plurality of deposit chute pairs 110, 112, 114, 116, 118 and operator station pairs 120, 122, 124, 126.

The deposit chutes 110–118 may, in one embodiment, be large chutes which open into lower deposit banks. The lower deposit banks are located below the elevated platform 105 directly beneath the chutes 110–118 and will be described with reference to FIG. 2. The operator stations 120–126 are situated between the deposit chutes 110–118 and next to the main conveyor 104 so that the deposit chutes 110–118 as well as any refuse which is carried past the operator stations 120–126 is within easy reach of an operator.

The main conveyor 104 is perpendicular to a belt transfer conveyor 130 located at the outlet end of the conveyor 104, so that any refuse which is carried past the operator stations 120–126 can be deposited onto the transfer conveyor 130 from the main conveyor 104. A vibrating screen input slide 132 is located at the outlet end of the transfer conveyor 130 to funnel the refuse by means of vibration. A coarse refuse screen 140, which is constructed to have rubber coated vibrating fingers, is located at the end of the slide 132. The fingers of the screen 140 are spaced approximately 8 inches, so that refuse which is smaller than 8 inches in any dimension typically falls through the screen fingers, and onto a screen input vibrating slide 144. The vibrating slide 144 is situated directly beneath the screen 140, and is included as part of a refuse processing branch that runs perpendicular to the direction of motion of the refuse on the screen 140.

The vibrating of the screen 140 is synchronized so that refuse larger than 8 inches is able to be carried across the screen 140 to a vibrating output conveyor 148. The vibrating output conveyor 148 acts as a transfer connection between the coarse screen 140 and a secondary belt conveyor 150. The secondary belt conveyor 150 is situated on an elevated platform 151, and extends through a plurality of secondary deposit chute pairs 152, 154, 156, 158 and operator station pairs 162, 164, 166. The configuration of the belt 150, the chutes 152–158, and the operator stations 162–166 is similar to that of the main conveyor 104, the chutes 110–118, and the stations 120–126. That is, the operator stations 162–166 are situated between the chutes 152–158 respectively, within easy reach of the belt 150 and the chutes 152–158. In addition, deposit banks (described below with reference to FIG. 2) are located below the platform 151 directly beneath the chutes 152–158. A pivotable belt conveyor 167 is located at the outlet end of the secondary conveyor 150, so that refuse which is carried past the operator stations 162–166 is able to be deposited onto the pivotable conveyor 167. A reversible belt conveyor 168 is located at the end of the pivotable conveyor 167, so that refuse which is transported by means of the conveyor 167 can be deposited onto the reversible conveyor 168 where the refuse may be conveyed to one of two locations. In an advantageous embodiment, a second reversible belt conveyor 169 is located at one end of the reversible conveyor 168 so that the second reversible conveyor 169 is at a lower level than the conveyor 168.

The second refuse processing branch which runs perpendicular to the general direction of flow on the first branch includes a bottle and can inlet port 172, which is constructed to receive bottles and cans of various sizes and materials. In one embodiment, the bottles and cans which are to be loaded into the port 172 are presized to be less than 8 inches in any one dimension. The inlet port 172 is approximately 6–8 feet wide at the mouth and is funnel shaped to deliver the bottles and cans onto a receiving end of a belt conveyor 170 which has an output end at the vibrating slide 144.

The vibrating slide 144 is connected to a fine screen 175 which is constructed to have rubber coated vibrating fingers. The fingers of the screen 175 are spaced approximately 1½ inches apart, so that refuse which is smaller than 1½ inches in any dimension typically falls through the fingers of the screen 175. This fallen refuse may be deposited onto another conveyor (not shown here) which runs beneath the screen 175 parallel to the general direction of conveyor 170, or may be deposited directly into a refuse bin. The vibrations of the screen 175 allow refuse which is sized so that it does not fall through the screen 175 to be transferred to a vibrating conveyor 178. A cyclone air classifier 180, which generates a strong flow of air to remove lightweight paper products and the like from the flow of refuse, is located at the front end of the conveyor 178. Any suitable, commercially available air classifier may be employed. The conveyor 178 is adjacent a specially constructed multiple-sort vibrating conveyor 185.

The conveyor 185 extends through, and constitutes one element of, a super-station sub-facility 187 which is shown and described in greater detail with reference to FIGS. 3*a* and 3*b* below. The vibrating conveyor 185 is elevated upon a platform 186 and is powered by a motor 188. The conveyor 185 extends past a plurality of peripherally located deposit chute pairs 190, 192, 194, 196, as well as a plurality of operator station pairs 200, 202, 204. The configuration of the conveyor 185, the chutes 190–196, and the operator stations 200–204 is similar to that of the conveyor 104, the chutes 110–118, and the operator stations 120–126 except that the conveyor 185 includes additional central deposit chutes 210. The central deposit chutes 210 are situated along the length of the conveyor 185 and are formed within the conveyor 185 itself. Preferably, the central deposit chutes 210 are positioned between each operator station pair 200–204 so that the chutes 210 are within easy reach of each operator station 200–204. In one embodiment, each deposit chute 210 includes three deposit apertures 212, 214, 216. Each deposit aperture 212, 214, 216 empties into a separate compartment of a sub-conveyor 218 (shown in hidden lines) which serves a dual purpose as a counterweight and as a multiple compartment conveyor that runs parallel to and beneath the conveyor 185.

The conveyor 185 continues past the operator stations 200–204 to any commercially available overhead magnet 220 which is capable of extracting significantly sized pieces of ferrite from the refuse left on the conveyor 185. At the end of the conveyor 185, past the overhead magnet 220, a vibrating trash conveyor 230 is provided to transport the remaining refuse to a trash bin 232. The sub-conveyor 218 continues to run below the trash conveyor 230, so that recyclable materials within each of the three compartments of the sub-conveyor 218 are able to be deposited in the appropriate one of the bins 240, 242, 244.

The operation of the refuse recycling system 100 is able to be controlled automatically from a control deck 250 located, in one embodiment, near the transfer conveyor 130. The control deck may, for example, include appropriate electronics such as an Allen-Bradley controller, which is able to control the mechanical operations of the different components of the system 100.

In addition to the components described above, the system 100 may include a plurality of bailers 265, 275 which receive recyclable goods (e.g., from the deposit banks beneath the deposit chutes) by means of bailer conveyor belts 260, 270 respectively, and packages these goods for transport or reprocessing.

Although not shown here in FIG. 1, the refuse recycling system 100 advantageously includes a trash compaction pit wherein non-recyclable trash which is output from the system 100 (e.g., from the trash bin 232) may be compacted and transferred to a dump site.

Figure 2:
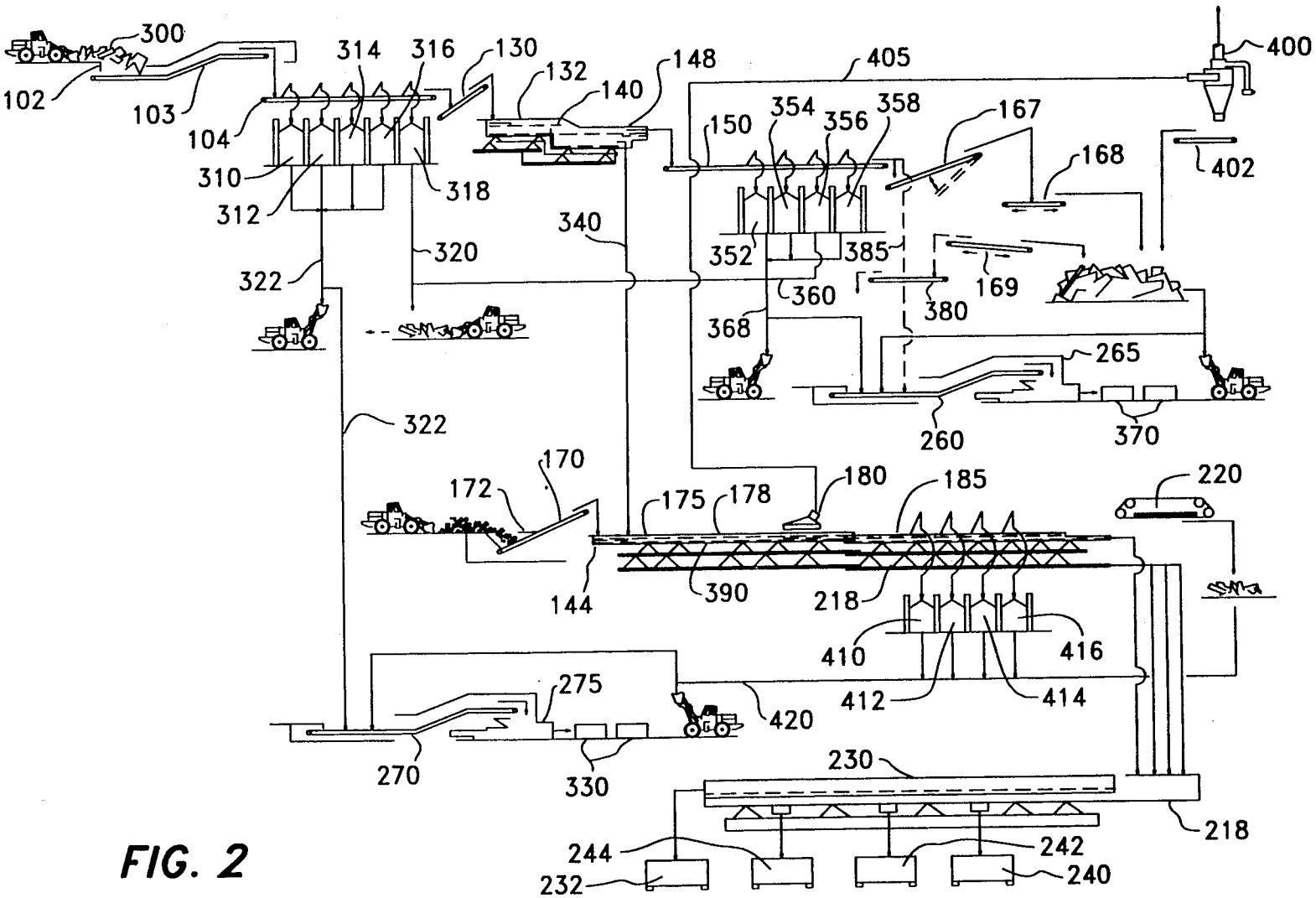
FIG. 2 is a schematic material flow diagram which details the overall method of operation of the refuse recycling facility.

Referring also now to FIG. 2, which shows a schematic material flow diagram that details the operation of the system 100, an operator feeds recyclable refuse 300 into the inlet port 102 by means of a tractor or other heavy machinery. During normal operation, the refuse 300 is deposited onto the infeed conveyor 103, and the infeed conveyor 103 is motorized to transport the refuse 300 at a rate of approximately 1–2 feet per second to the main belt conveyor 104. The main belt conveyor conveys the refuse 300 past the operator station pairs 120–126 at a rate of approximately 1–2 feet per second, so that operators occupying the stations 120–126 are able to manually select and sort the refuse 300 which is carried past on the conveyor 104.

In one embodiment, each operator is assigned two types of recyclable materials which that operator is to extract from the flow of refuse 300, and each operator pair is assigned the same two types of recyclable materials. In this case, one type of recyclable material is deposited by the operator into the deposit chute on the operator's right, and the other type of recyclable material is to be deposited into the deposit chute on the operator's left. For example, the operator who is stationed at one station of the operator station pair 120 is able to deposit one type of material into the deposit chute 110, and another type of material into the deposit chute 112. Similarly, an operator stationed at one of the stations 122 is able to deposit one type of material into the chute 112, and another type into the chute 114.

A plurality of deposit banks 310, 312, 314, 316, 318 are provided below the deposit chutes 110–118, so that the materials which are deposited into each pair of chutes 110–118 are amassed within the corresponding bank 310–318. Thus, the materials deposited in either one of the chutes 110 are amassed within the bank 310, the materials deposited into the chutes 112 are amassed within the bank 312, etc. In one embodiment, each of the chutes 110–118 is adapted to receive one type of recyclable material, so that each bank 310–318 also amasses only one type of recyclable material. For example, in one application, the bank 318 receives bulky, non-recyclable trash, the bank 316 receives corrugated paper such as cardboard, the bank 314 receives wood, the bank 312 receives newspaper, and the bank 310 receives other bulky paper and wood products. The banks 310–318 are open on two sides, and are sufficiently large to allow heavy machinery (e.g., a tractor) to pass through and gather the materials which have amassed within each bank 310–318. As indicated by a flow path 320, the bulky trash within the bank 318 is transferred to the compaction pit (not shown) for mulching, and transfer to a dump site. The recyclable materials within the banks 310–316, however, are transferred to the bailer conveyor 270 as indicated by a flow path 322. The bailer conveyor 270 feeds the recyclable material into the bailer 275, which compresses the materials into easily transportable bails 330. These bails 330 may then be shipped for processing to produce recycled goods.

The refuse 300 which is not extracted from the refuse flow on the conveyor 104 is carried to the conveyor 130, and from there is transferred to a vibrating screen input slide 132. The vibrating screen input slide 132 funnels the refuse 300 onto the coarse vibrating screen 140 where those materials within the refuse flow which are less than 8 inches in any dimension pass through the screen 140 and are deposited onto the vibrating slide 144 as indicated by a flow path 340. The refuse having dimensions greater than 8 inches are carried over the screen 140 to the output conveyor 148. The bulky refuse (i.e., the refuse which is allowed to pass over the screen 140) is then deposited onto the conveyor 150 where the bulky refuse passes through a second manual sorting stage.

As the bulky elements of the refuse 300 are transferred past the operator stations 162–166, the operators manually extract specified materials from the flow of refuse and deposit the extracted materials into designated chutes 152–158. This process is similar to that employed in the first sorting stage along the main conveyor 104. Thus, each operator selects two different types of material and deposits one type in the chute to the right and another type into the chute on the left.

As in the previous sorting stage, each pair of the chutes 152–158 opens into corresponding deposit banks 352, 354, 356, 358. Each chute pair 152–158 is assigned a particular type of refuse, so that only one type of refuse is deposited into each of the banks 352–358. For example, in one application, the bank 352 receives products constructed of poly-ethylene-tolulene (PET), the bank 354 receives products made from high-density polyethylene, the bank 356 receives non-recyclable trash, and the bank 358 receives hard plastics. The banks 352–358 are open on two sides, and are sufficiently large to allow heavy machinery (e.g., a tractor) to pass through and gather the materials which have amassed within each bank 352–358. As indicated by a flow path 360, the trash amassed within the bank 356 is transferred to the compaction pit. The recyclable materials within the banks 352, 354, and 358, however, are transferred to the bailer conveyor 260 as indicated by a flow path 368. The bailer conveyor 260 feeds the recyclable material into the bailer 265, which compresses the materials into easily transportable bails 370. These bails 370 may then be shipped for processing to produce recycled goods.

The materials which are not extracted from the refuse flow along the conveyor 150 pass off the end of the conveyor 150 onto the pivotable conveyor 167. The pivotable conveyor 167 is able to pivot about one end so that the conveyor 167 may assume more than one position as shown in phantom in FIG. 2. In the first position of the conveyor 167 (shown in solid lines), refuse from the conveyor 150 is transferred onto the reversible conveyor 168. The conveyor 168 may transport materials in one of two directions, so that the refuse on the conveyor 168 can be carried over one edge of the conveyor 168 onto a first disposal location, or, when the conveyor 168 is operating in the other direction, the refuse on the conveyor can be transferred to the reversible conveyor 169. The reversible conveyor 169 operates in much the same way as the conveyor 168, so that refuse received from the conveyor 168 may be transferred over one edge of the conveyor 169 to a second disposal location, or may be transferred over the other edge of the conveyor 169 to a conveyor 380 which transfers refuse to the compaction pit. Thus, refuse which is received from the pivotable conveyor 167 may be deposited in one of three locations: the first deposit location, the second deposit location, and the compaction pit.

As mentioned above, the conveyor 167 is pivotable, so that the conveyor 167 may assume more than one position. In a second position (shown in phantom in FIG. 2), the conveyor 167 is misaligned with the end of the conveyor 150 so that refuse from the end of the conveyor 150 does not fall onto the conveyor 167, but instead falls directly onto the bailer conveyor 260 as indicated by an alternate flow path 385 shown in dashed lines in FIG. 2. The refuse which is received directly from the conveyor 150 is transported to the bailer 265. In one embodiment, the refuse which is output from the end of the conveyor 150 comprises mixed paper goods which are sized to be greater than 8 inches in more than one dimension. This completes the sorting process for those goods which are sized over 8 inches in any dimension.

The refuse 300 which is sized less than eight inches, and is allowed to pass through the screen 140, drops onto the slide 144 as indicated by the flow path 340. Presized bottles and cans are also fed into the slide 144 by means of the inlet port 172 and the conveyor 170. These goods are then passed onto the screen 175 where those materials which are sized to be less than 1½ inches are deposited into a lower conveyor 390 which runs beneath the conveyors 178 and 185. The refuse which is sized to be greater than 1½ inches passes over the screen and is further conveyed by the vibrating conveyor 178 to the air classifier 180.

The air classifier 180 behaves like a large vacuum which draws small pieces of paper products (e.g., envelopes, etc.) into the vacuum chamber and deposits these products onto a small conveyor 402 at an exhaust outlet 400 of the air classifier 180. The transfer of the paper goods from the air classifier 180 to the exhaust outlet 400 is indicated by a flow path 405. In one embodiment, the conveyor 402 relays the paper products to the first disposal location at the end of the conveyor 168.

Those materials which are not removed by means of the air classifier 180 are transferred to the vibrating conveyor 185 at the beginning of the super-station subfacility 187. Once on the conveyor 185, refuse is transported past the operator station pairs 200–204 so that the refuse can be sorted manually by the operators who occupy the stations 200–204. As with the sorting stages along the conveyors 104, 150, the peripheral chutes 190–196 are situated along the conveyor 185. The chutes 190–196 open into a plurality of corresponding deposit banks 410, 412, 414, 416 which each receive a particular type of refuse material from the corresponding pair of deposit chutes 190–196. The banks 410–416 are constructed similarly to the banks 310–318 and 352–358 so that they are open at two ends. Thus, machinery may be used to clear out the banks 410–416 so that recyclable materials amassed within the banks 410–416 can be transferred to the bailer conveyor 270 as indicated by a flow path 420. In one embodiment, the materials which are to be loaded into the banks 410–416 may, for example, comprise plastics, aluminum, or other recyclable materials.

In addition to the peripheral chutes 190–196, the central chutes 210 are spaced along the conveyor 185. The central chutes 210 are advantageously situated in the middle of the conveyor path 185 so that they are opposite each operator (e.g., between each operator station pair 200–204), and within easy reach of the operator stations 200–204. Operators who occupy the stations 200–204 are therefore able to manually extract recyclable materials from the refuse flow and deposit these extracted materials into one of the three apertures 212, 214, 216 within the chutes 210. Therefore, rather than the two selection options which are typically provided to each of the operators stationed at sorting facilities which do not include centrally located chutes, five selection options are presented to operators stationed at the stations 200–204. The extraction and classification of more than two types of recyclable refuse per operator may be done quickly and easily since the operators are not required to turn away from the conveyor 185 when selecting and depositing materials into the chutes 210. For this reason it has been found that the operators are able to extract and classify more kinds of refuse while suffering little or no drop off in efficiency when compared to operators who are stationed at conventional two-chute stations. The overall capacity of the super-station sorting stage 187 to extract and classify recyclable refuse is therefore increased considerably when compared with conventional sorting facilities.

In one embodiment, the materials which are extracted from the refuse flow on the conveyor 185, and are deposited into the chutes 210 comprise green, brown, and clear glass. The materials deposited into the apertures 212, 214, 216 fall into separate compartments of the sub-conveyor 218 which, in addition to serving as a counterweight for the conveyor 185, conveys the deposited materials into the appropriate bins 240, 242, 244.

Those materials which are not extracted from the refuse flow along the conveyor 185 are conveyed to the overhead magnet 220. The overhead magnet 220 removes sizable ferrous materials from the refuse flow, and deposits these materials onto a ferrous material disposal location. These ferrous materials may then be transferred to the bailer conveyor 270 by means of heavy machinery as indicated by the flow path 420. The materials which are not removed by the overhead magnet 220 are combined with the small (i.e., less than 1½ inch) materials on the lower conveyor 390 and are transferred to the conveyor 230. The remaining refuse on the conveyor 230 is then discarded into the trash bin 232 where the refuse is held until it can be transported to the compaction pit.

The operation of the refuse recycling system 100 has been described somewhat generically above, however, it should be noted that the operation of the system 100 may be modified by means of the control deck 250 in accordance with the kinds of refuse which it is expected will be input into the system 100. For example, commercial and residential refuse generally have different make-ups and include different types as well as different proportions of recyclable materials. In accordance with one aspect of the invention, the conveying speeds of the different conveyors within the system 100 may be altered. In addition, the directions of the reversible conveyors 168, 169, as well as the position of the pivotable conveyor 167 may be changed by means of the control deck 250. Appropriate modifications to the operation of the system 100 made by the control deck 250 serve to further increase the efficiency of the system 100 when it is known what kind of refuse will be input into the system 100.

In one embodiment, the controller located at the control deck 250 may be operated automatically by means of computer software which includes at least one operation program for each kind of refuse (e.g., commercial or residential). By utilizing an operation program for commercial refuse, the speeds and/or directions of selected conveyors may be modified so that they differ from the speeds and directions of the same conveyors as typically used in the residential refuse recycling mode. For example, in a preferred embodiment, the speeds of the input conveyor 103, the pre-sort conveyor 104, and the main-sort conveyor 150 may be increased by 25%. In addition, the conveyor 168 may be reversed so that it does not carry refuse to the conveyor 169, or the conveyor 169 may be reversed so that it does not carry refuse to the compaction pit.

Figure 3A:
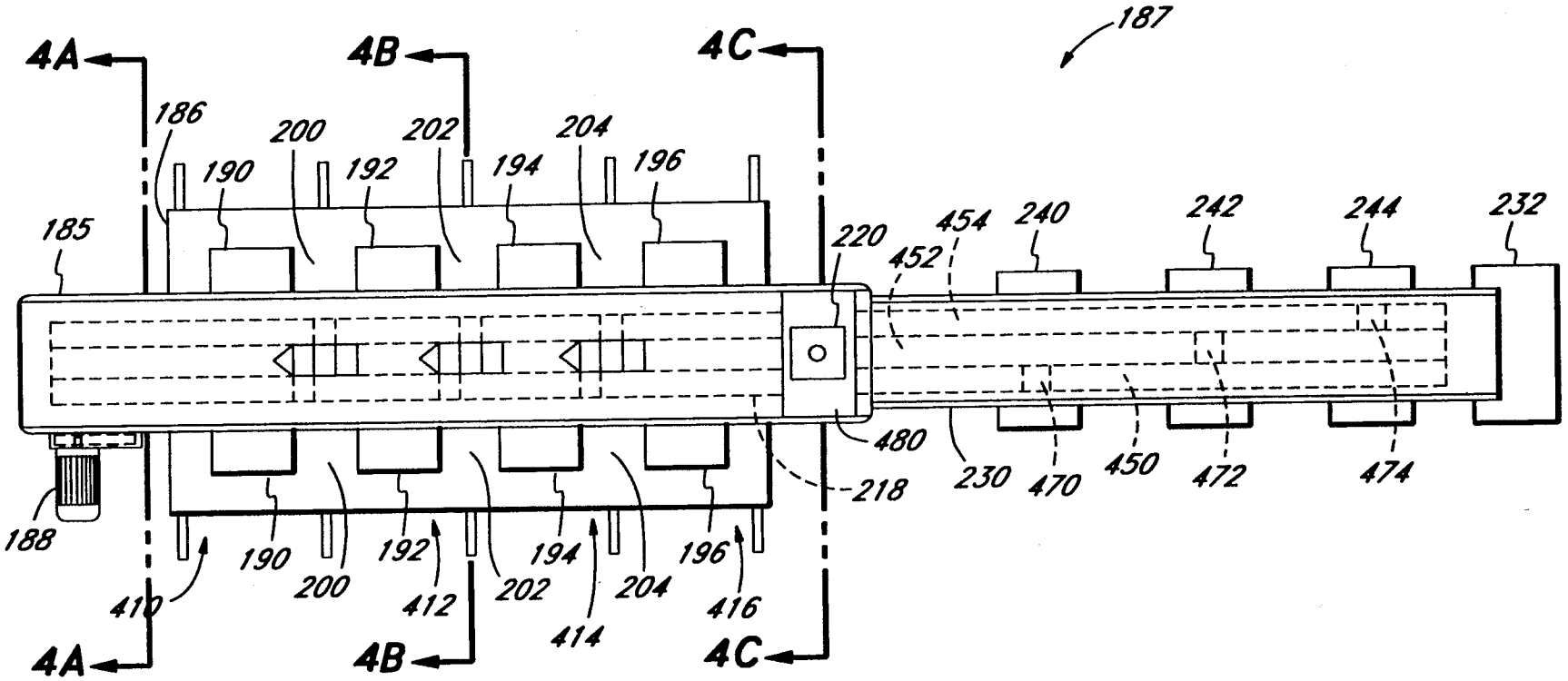
FIGS. 3*a* and 3*b* are plan and elevational schematic views respectively which show the super-station refuse processing sub-system in greater detail.
Figure 3B:
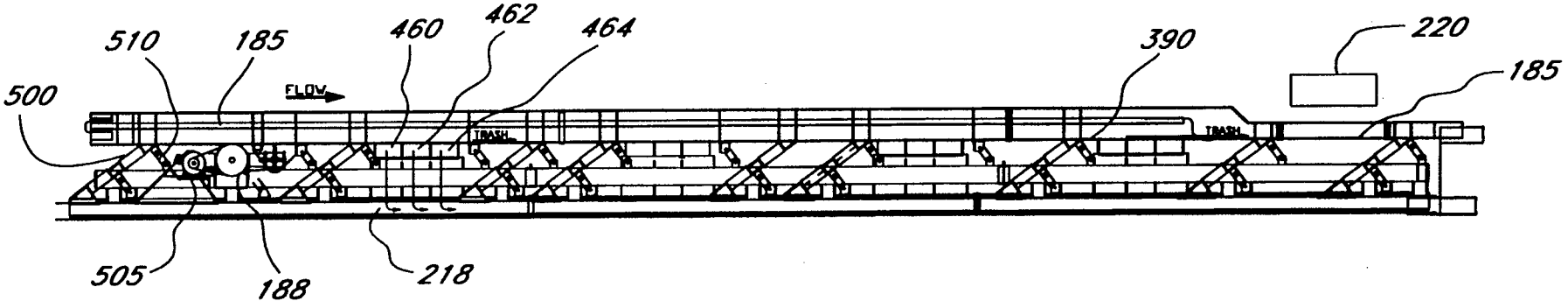
Figure 4A:
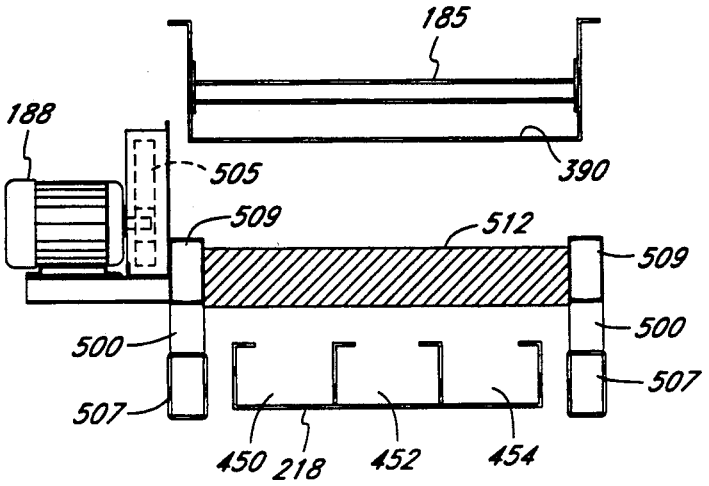
FIGS. 4*a*–4*c* are cross-sectional views of the super-station refuse processing sub-system along selected lines as shown in FIGS. 3*a* and 3*b*.
Figure 4B:
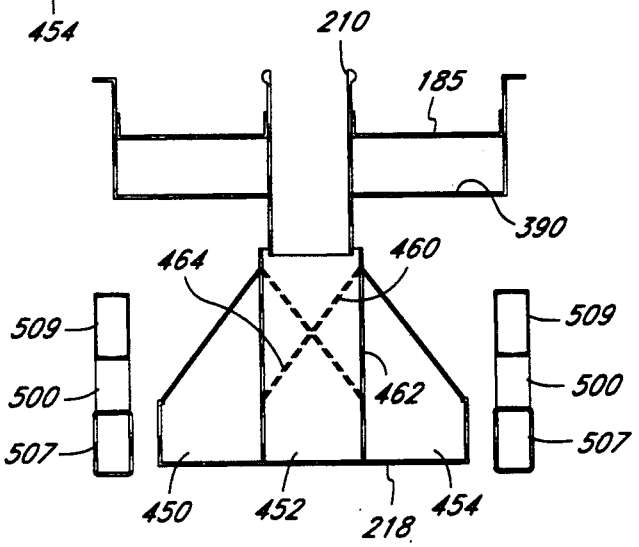
Figure 4C:
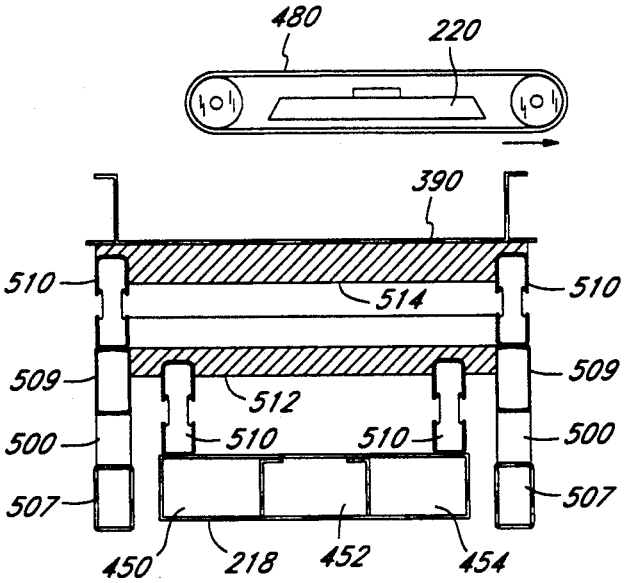

FIGS. 3*a* and 3*b* are plan and side elevational views respectively of the super-station sub-facility 187, and FIGS. 4*a*–4*c* are cross-sectional views of the super-station 187 which depict the major components of the super-station 187 in greater detail.

Referring to FIG. 3*a*, an enlarged plan view of the super-station 187 is shown. In one embodiment, the total length of the super-station is approximately 135 feet from the beginning of the conveyor 185 to the end of the conveyor 230, and the width of the conveyor 185 is approximately 5–6 feet. The central chutes 210 are also shown in FIG. 3*a*, and are spaced equally along the conveyor 185 at intervals of approximately 10 feet. In one embodiment, the central chutes 210 are constructed to be 3 feet long by 2 feet wide. The apertures 212, 214, 216 are separated at equal intervals so that each of the apertures 212, 214, 216 is approximately 1 foot by 2 feet in area. The chutes 210 are positioned directly between the operator station pairs 200–204 so that the chutes 210 are about 2 feet from the operator stations on each side of the conveyor 185. Thus, the chutes 210 are directly in sight and within easy reach of the operator stations 200–204.

In one advantageous embodiment, dividers 440 are included at the front ends of the chutes 210. The dividers 440 are preferably coated with rubber or other soft, durable material, as are the sides of the chutes 210 and the inside edges of the conveyor 185. The dividers 440 act to divide refuse which is conveyed by the vibrating motion of the conveyor 185 so that the refuse flows into one of two channels on either side of the chutes 210.

The chutes 210, having the apertures 212, 214, 216 formed therein, allow refuse to be deposited into the sub-conveyor 218. The sub-conveyor 218 is shown in hidden lines to include a channel 450, a channel 452, and a channel 454. Each of the channels 450–454 is approximately 1 foot wide, and receives refuse from the chutes 210 by means of the apertures 212, 214, 216. The apertures 212, 214, 216 are connected to the channels 450, 452, 454 respectively by means of ducts 460, 462 (FIG. 4*b*), 464. The ducts 460, 464 are shown in hidden lines in FIG. 3*a*. The channels 450, 452, 454 extend along the conveyor 218 to openings 470, 472, 474 which are located above the bins 240, 242, 244 respectively. Thus, materials which are extracted from the refuse flow and are deposited into one of the apertures, for example the aperture 212, will be carried into the channel 450 by means of the duct 460. The deposited materials will then be carried to the aperture 470 by means of the vibrating action of the conveyor 218. This means that the materials deposited into the aperture 212 will be accumulated within the bin 240, the materials deposited into the aperture 214 will be accumulated within the bin 242, and the materials deposited into the aperture 216 will be accumulated within the bin 244. In one application, the materials which are deposited within each of the apertures comprise green glass (bin 240), clear glass (bin 242), and brown glass (bin 244).

Thus, in the super-station sub-facility 187, each operator at the operating stations 200–204 is able to extract up to five different kinds of recyclable materials from the flow of refuse along the conveyor 185. This is a significant improvement over the previous systems which typically limit operators to only two types of recyclable materials. Of course, it should be noted that the present invention may include more or less than three apertures within the centrally located chutes 210. The number of apertures which may be included within the chutes 210 should be determined in accordance with the specific application of the system 100 as well as the capacities of the system operators. In addition, it is not necessary to situate the chutes 210 in the middle of the conveyor 185, so long as the chutes 210 are disposed substantially in front and within easy reach of the operator stations 200–204. It has been found, however, that it is particularly advantageous to place the chutes so that the flow of refuse passes between the operator stations 200–204 and the chutes 210.

Those materials which are not deposited into the apertures 212, 214, 216 or the peripheral chutes 190–196, are transported to the overhead magnet 220. The overhead magnet 220 attracts ferrous materials (such as tin cans, chunks of iron, etc.) so that these materials are lifted from the flow of refuse on the conveyor 185. The magnet 220 is positioned within a rapidly moving conveyor 480 so that the attractive face of the magnet 220 is a few inches above the conveying belt, and 1–1½ feet above the surface of the conveyor 185. The magnetic field created by the magnet 220 is sufficient to penetrate the conveyor belt 480 and to draw the ferrous materials out of the flow of refuse. The ferrous materials are then held to the surface of the belt 480 by the magnetic field, and are carried sideways with the belt 480 as the belt 480 moves. As the belt 480 moves along, it passes out of the magnetic field so that the strength of the field is not sufficient to hold the ferrous materials on the belt 480. The momentum of the ferrous materials causes the materials to be cast over the side of the conveyor 185 onto a ferrous material disposal location where the ferrous materials may be amassed for later bailing and processing.

FIG. 3*b* shows a side elevational view of the major components of the super-station 187. The elevational view more clearly shows the three conveyor levels (all shown in hidden lines) which run along the super-station 187. As shown in FIG. 3*b*, the top conveyor level 185 is situated directly above the lower conveyor level 390 in the region of the super-station which precedes the overhead magnet 220. The top conveyor 185 then empties into the conveyor 390 just prior to the magnet 220. The refuse on the lower conveyor 390 is then transported beneath the magnet 220 and is then transferred to the conveyor 230 where it is conveyed to the trash bin 232. The sub-conveyor 218 is specially formed within the counterweight used in conjunction with the vibrating conveyors 185, 390, and is connected by means of mounting legs 500 and connecting rods 510 to the conveyors 185, 390. The counter-vibrations of the sub-conveyor 218 cause materials in each of the three channels 450, 452, 454 to be conveyed to the openings 470, 472, 474 so that the materials drop into the appropriate bins 240, 242, 244.

FIGS. 4*a*, 4*b*, and 4*c* are cross-sectional views taken along the lines 4*a*—4*a*, 4*b*—4*b*, and 4*c*—4*c* (FIG. 3*a*) which show the major structural elements of the super-station 187 in cross-section. In one embodiment, the lower conveyor 390 shown in FIGS. 4*a* and 4*b* is approximately 9 inches below the conveyor 185, while the sub-conveyor 218 having the three channels 450, 452, 454 is approximately 3½ feet beneath the surface of the lower conveyor 390.

FIG. 4*a* is a cross-sectional view along the line 4*a*—4*a* which shows the motor 188 connected to one side of a pair of conveyor frame rails 509 by means of a power transfer belt 505. The frame rails 509 are connected by a cross beam 512. The frame rails 509 are also connected to the mounting legs 500, which are connected to a pair of conveyor platform mounting members 507. In addition to the mounting legs 500, high tension springs (not shown here) may be mounted between the frame rails 509 and the platform mounting members 507. The frame rails 509 and the platform mounting members 507 may comprise hollow metal rails or the like to provide sufficient structural support while remaining lightweight. In one embodiment, the rails 509 and the mounting members 507 are approximately ten inches by seven inches in cross section, and the vertical distance between the frame rails 509 and the mounting members 507 is about eight inches.

The motor 188 generates mechanical vibrations within the conveyors 185, 390, and 218 by means of the belt 505 and the structural supporting members (i.e., the legs 500, the mounting members 507, the frame rails 509, the connecting rods 512, and the cross-beam 512). These mechanical vibrations are synchronized, in a manner which is well-known in the art, so as to cause matter on the surface of each of the conveyors 185, 390, 218 to move in one direction at a constant velocity (e.g., 9 inches per second). It should be noted that the surfaces of each of the conveyors may be advantageously coated in rubber or another impact absorbing substance to prevent any unnecessary breakage of brittle or fragile materials due to the vibrations of the conveyors.

FIG. 4*b* is a cross-sectional view along the line 4*b*—4*b* located at one of the chutes 210. The chute 210 is located in the middle of the conveyor 185 so that the conveyor 185 and the lower conveyor 390 are divided into two channels which pass on either side of the chute 210. The duct 462 which connects the channel 452 to the aperture 216 is shown in solid lines to descend directly to the sub-conveyor 218. The ducts 460, 464 which are behind the duct 462 are shown in hidden lines to angle left and right respectively into the channels 450, 454. In one embodiment, each of the channels 450, 452, 454 is approximately sixteen inches in width and ten inches high.

FIG. 4*c* is a cross-sectional view along the line 4*c*—4*c* located at the overhead magnet 220. The magnet 220 is situated within the belt conveyor 480 as shown, and is directly above the conveyor 390 which includes refuse from the conveyor 185 as well as the refuse which is sized to be less than 1½ inches. The connecting rods 510 are also shown more clearly in FIG. 4*c* as components in the structural design of the super-station 187. The outer pair of connecting rods 510 connect the conveyor 390 to the balancing conveyor 218, while the inner pair of connecting rods 510 act as connectors between the conveyor 218 and the main frame of the super-station 187. The outer pair of connecting rods 510 are shown to be connected to an upper cross-beam 514 which is affixed to the base of the upper conveyor 390. Thus, the connecting rods 510 provide a firm connection between each of the conveyor levels of the super-station 187.

The refuse recycling system of the present invention may be embodied in a variety of forms other than those described here which will be readily understood by those skilled in the art. For example, the super-station may be implemented using material transporting devices, other than a vibrating conveyor, which allow for multiple deposit chutes to be located in front of each operator position. Accordingly, the foregoing description should be construed as illustrative and not restrictive. The scope of the invention should therefore be interpreted in light of the appended claims and any equivalents thereof which fall within the spirit of the claimed invention.

What is claimed is:

1. A refuse recycling system for recovering recyclable materials from a flow of refuse, said system comprising:

a refuse input port for receiving said refuse;

a plurality of refuse separating stations, each of which accommodates an operator;

a primary conveyor for conveying said flow of refuse from said input port past said refuse separating stations;

a plurality of receptacles at said stations for receiving refuse manually selected from said conveyor and placed in said receptacles;

a sorting screen receiving refuse not selected at said separating stations;

a secondary conveyor for conveying material too large to fall through said sorting screen;

a plurality of refuse selector stations adjacent said second conveyor, and a plurality of receptacles adjacent said secondary conveyor for manually receiving certain categories of refuse from said secondary conveyor;

a vibrating conveyor positioned to receive refuse which has fallen through said screen;

a plurality of refuse separating stations adjacent said vibrating conveyor including a pair of side chutes spaced to permit an operator to be located between said spaced chutes and select certain categories of material moved past the spaced chutes by said vibrating conveyor.

2. The system of claim 1, wherein said vibrating conveyor includes a centrally positioned divider for dividing the flow of refuse moved along said vibrating conveyor into two flows; and a plurality of chutes centrally positioned within said vibrating conveyor adjacent said divider to permit an operator at each of said separator stations adjacent said vibrating conveyor to select material from one of said flows to be positioned either within said centrally located chutes or said side chutes.

3. The system of claim 1, including a subconveyor connected to serve as a counterbalance to said vibrating conveyor and positioned beneath said vibrating conveyor to receive material from the chutes adjacent said vibrating conveyor to direct such materials to selected receptacles.

4. The system of claim 1, including a controller for controlling the speed and direction of said conveyors in accordance with the kind of refuse input at said refuse input port.

5. A method of recycling refuse for recovering recyclable materials comprising:

transporting refuse through an input port onto a first refuse transporting device;

conveying refuse on said device past a first separator station;

removing bulky refuse items from said conveying device and placing the removed items into receptacles adjacent said conveying device;

conveying the remaining refuse on said device across a sorting screen having opening allowing refuse smaller than the openings to fall through said screen;

conveying with a second device the materials not falling through the screen past a second separator station for selecting various categories of refuse too large to have fallen through said screen;

conveying with a third device the refuse that fell through said screen, past a third separator station; and manually selecting various categories of material on said third device and placing such selected refuse into chutes adjacent said third separating station.

6. The method of claim 5, wherein the conveying of the refuse falling through said screen includes vibrating a vibrating conveyor to move refuse past said third separating station; and dividing the screened refuse into two flow paths, one on each side of a plurality of refuse chutes located in the center of the vibrating conveyor adjacent said third separating station; and manually selecting categories of screened refuse from said vibrating conveyor and placing them in the chutes centrally positioned in said vibrating conveyor or in chutes positioned on each side of said third separating station.

* * * * *